US007178324B2

(12) United States Patent
Sakita

(10) Patent No.: US 7,178,324 B2
(45) Date of Patent: Feb. 20, 2007

(54) EXTERNAL COMBUSTION ENGINE

(76) Inventor: Masami Sakita, P.O. Box 61089, Palo Alto, CA (US) 94306-1089

( * ) Notice: Subject to any disclaimer, the term of this patent is extended or adjusted under 35 U.S.C. 154(b) by 0 days.

(21) Appl. No.: 11/233,801

(22) Filed: Sep. 24, 2005

(65) Prior Publication Data

US 2006/0064976 A1 Mar. 30, 2006

Related U.S. Application Data

(60) Provisional application No. 60/612,867, filed on Sep. 24, 2004.

(51) Int. Cl.
*F02G 3/00* (2006.01)

(52) U.S. Cl. ..... 60/39.02; 60/525

(58) Field of Classification Search ..... 60/39.2, 60/517, 525

See application file for complete search history.

(56) References Cited

U.S. PATENT DOCUMENTS 3,426,525 A 2/1969 Rubin
3,509,718 A 5/1970 Fezer et al.
3,762,167 A 10/1973 Wahnshaffe et al.
3,763,649 A 10/1973 Whanshaffe et al.
3,896,632 A * 7/1975 Huntley ..... 62/88
4,077,221 A 3/1978 Maeda
4,235,079 A * 11/1980 Masser ..... 62/87
4,644,752 A * 2/1987 Nam ..... 60/716
4,869,212 A * 9/1989 Sverdlin ..... 123/51 B
4,881,372 A * 11/1989 Naito ..... 60/521
5,228,293 A 7/1993 Vitale
5,343,704 A * 9/1994 Kanzaki et al. ..... 60/525
6,109,040 A 8/2000 Ellison, Jr. et al.
6,487,858 B2 * 12/2002 Cammack ..... 60/517

OTHER PUBLICATIONS

Steam Car Developments and Steam Aviation, vol. IV. Jun. 1935, No. 40, Stanleysteamers.com.

* cited by examiner

*Primary Examiner*—Hoang Nguyen

(57) ABSTRACT

An external combustion engine comprises a compressor assembly, a heater assembly, an expander assembly, a cooler assembly, and auxiliary systems. The preferred embodiment of this invention uses fossil fuel as the main source of energy, and water substance for the working liquid. The compressor assembly takes in the working fluid Heating chambers in the heater assembly that is sandwiched between the compressor assembly and the expander assembly heats up the working fluid. The expander assembly generates the rotational force. In the preferred embodiment, the working fluid taken into the compressor assembly is generally water vapor. Alternative embodiments include an engine that uses sunlight as the energy source, and an engine with a pump assembly that takes in water instead of water vapor.

12 Claims, 12 Drawing Sheets

EXTERNAL COMBUSTION ENGINE

DOMESTIC PRIORITY

This application is entitled to the benefit of provisional application 60/612,867 filed on Sep. 24, 2004, entitled "Stirling Engine."

FIELD OF THE INVENTION

This invention relates generally to an external combustion engine that uses water substance for the working fluid.

BACKGROUND OF THE INVENTION

Steam engines with reciprocating pistons were once used for various transportation systems including railway locomotives, ships and automobiles. Later versions of steam engines used for automobiles are equipped with multiple cylinders with reciprocating pistons, a steam generator that includes a boiler and a burner, a condenser, and a water tank. In these engines, engine activities involve the following four stages: first stage—water is pumped into the steam generator; second stage—steam is generated by the stream generator; third stage—the steam is taken into a valve-controlled working chamber of the engine at minimum cylinder volume, and the steam pushes the piston and gives rotational force to the driveshaft; fourth stage—the steam is exhausted by the piston, and the exhaust steam is cooled by the condenser, and goes back to the water tank.

The steam piston engine used for automobiles is well known for its ability to produce large torque. It is reported that Stanley 20 HP two-cylinder engine develops 640 ft-lbs of maximum torque, and the legendary Doble car engine develops 2200 ft-lbs of maximum torque. (James D. Crank, "A Fresh View of the Steam Car for Today," Doble Steam Motors Corporation, Stanleysteamers.com). It is said that the Doble cars produced between 1923 and 1939 weighing over 4000 lbs could accelerate from 0 to 70 mph in under 5 seconds, and could maintain a top speed of 95 mph. Most steam-powered cars, however, could not start the engine instantaneously. The is commonly believed to be the main reason that the steam engine car lost the battle against the internal combustion engine cars. The problem of inability to start instantaneously was solved by providing a carburetor and spark plugs according to a paper entitled "Steam Motor-Vehicles" presented by Abner Doble, Vice President of General Engineering Company, presented on Oct. 20, 1916 in Cleveland.

Other improvements include the non-condensing cylinder, in which the cylinder head is covered with a steam jacket to prevent cylinder condensation, and the uniflow cylinder, in which the working fluid is let out of the main exhaust ports located in the middle of the cylinder wall enabling the superheated water vapor to get out of the cylinder when the piston is at around the end of the compression phase. Another improvement is multiple expansion engines, in which the exhaust vapor is reused to power the engine. A steam engine that does not use a separate boiler was invented by H. S. White of England (Provisional Patent No. 282580) as described in Steam Car Developments and Steam Aviation, Vol. IV. June 1935, No 40) though no reports on production of the engine is found. In this engine, a steam-generating chamber is affixed to the cylinder head of a piston cylinder and communications between the steam-generating chamber and the piston cylinder is controlled by a valve, and the water is pressure-fed into the steam-generating chamber by a pump.

The accepted thermodynamic standard with which the performance of the steam engine is compared is called Rankine cycle that is a special case (in the sense that the working fluid is water instead of hot air) of the Stirling cycle that consists of isothermal compression, isovolumetric pressure rise (or heating), isothermal expansion, and isovolumetric outlet (cooling). In the steam piston engine, like in the Stirling engine, the working fluid does not leave the engine's working chamber. The uniqueness of the water substance (similarly to any other condensable substance) is that if the saturated water vapor is compressed at constant temperature, the saturated water vapor will become a mixture of water and water vapor, and if the compression is continued further at the same temperature, the pressure will remain constant, and the mixture will finally become saturated water (see, for example, page 4–14 of Mark's Standard Handbook for Mechanical Engineering, $9^{th}$ Edition by Eugine A. Avallone and Theodore Baumeister III, McGraw Hill Company. Some Stirling cycle engine patents are relevant to the present invention. A Stirling engine that uses a compression mechanism and an expansion mechanism, as the engine of this invention does, is shown in U.S. Pat. No. 6,109,040.

The steam piston engine, if properly built and operated, may be as efficient as the Stirling engine, which has a reputation of being highly efficient. Regardless, the steam engine that uses an alternative fuel such as liquefied natural gas that costs a fraction of gasoline (to produce the same amount of energy) should be welcome by the users in general. The water that may be considered a curse (because it increases the weight) in non-stationary applications may be considered a blessing in stationary applications. In distributed electricity generation for households, the engine may be used for generating electricity, and the reject water may be used for general use in the house or heating the house in winter. In such an application, the electricity generated by the steam engine may be used not only for daily household use but also for producing hydrogen for hydrogen-powered automobiles. The steam engine that uses sunlight for a source of energy, as described in this specification, may also be a possibility.

OBJECTS OF THE INVENTION

An object of this invention is the provision of a fuel-efficient external combustion engine that uses water substance for the working fluid.

An object of this invention is the provision of an external combustion engine that operates relatively in a low temperature range.

An object of this invention is the provision of an external combustion engine that uses sunlight for a source of energy.

SUMMARY OF THE INVENTION

The engine of the present invention is an externally heated type that uses generally water substance for the working fluid. The externally heated engine comprises a compressor assembly, a heater assembly, an expander assembly, a cooler assembly that includes a working fluid storage tank and an oil separator, and auxiliary systems such as a lubrication system, a cooling system that cools down the cooling liquid used to cool down the engine, and a computer system that controls the engine. The compressor, the heater and the expander assemblies are housed in an engine housing separately from the cooler assembly and the auxiliary systems.

The compressor assembly has a plurality of compressor cylinders; the heater assembly has the same number of heating chambers as said compressor cylinders; and the expander assembly has a plurality of expander cylinders as the compressor cylinders; and the cooler assembly has a condenser and working fluid storage tank. Each of the compressor cylinders of the compressor assembly is serially aligned with a heating chamber, and an expander cylinder in sequential order. The working fluid, which is generally water substance, travels from the working fluid storage tank to one of the compressor cylinders, the heating chamber, the expander chamber, the condenser, and back to the storage tank.

The cooler assembly is provided in the closest vicinity practicable of the engine housing so that the travel distance of the circulating working fluid can be minimized. The inlet and outlet manifolds, inlet and outlet pipes, working fluid storage tank are all designed to sustain the exhaust water vapor pressure. Cooling of the working fluid is done by the use of two radiators. The first radiator that circulates the working fluid is provided to cool down the outlet working fluid exhausted from the expander assembly. The second radiator that circulates cooling liquid is used to cool down the working fluid in the working fluid storage tank.

BRIEF DESCRIPTION OF THE DRAWINGS

The above and other objects and advantages of this invention will become more clearly understood from the following description when considered with the accompanying drawings. It should be understood that the drawings are for purposes of illustration only and not by way of limitation of the invention. In the drawings, like reference characters refer to the same parts in the several views.

DETAILED DESCRIPTION OF THE INVENTION

Figure 1:
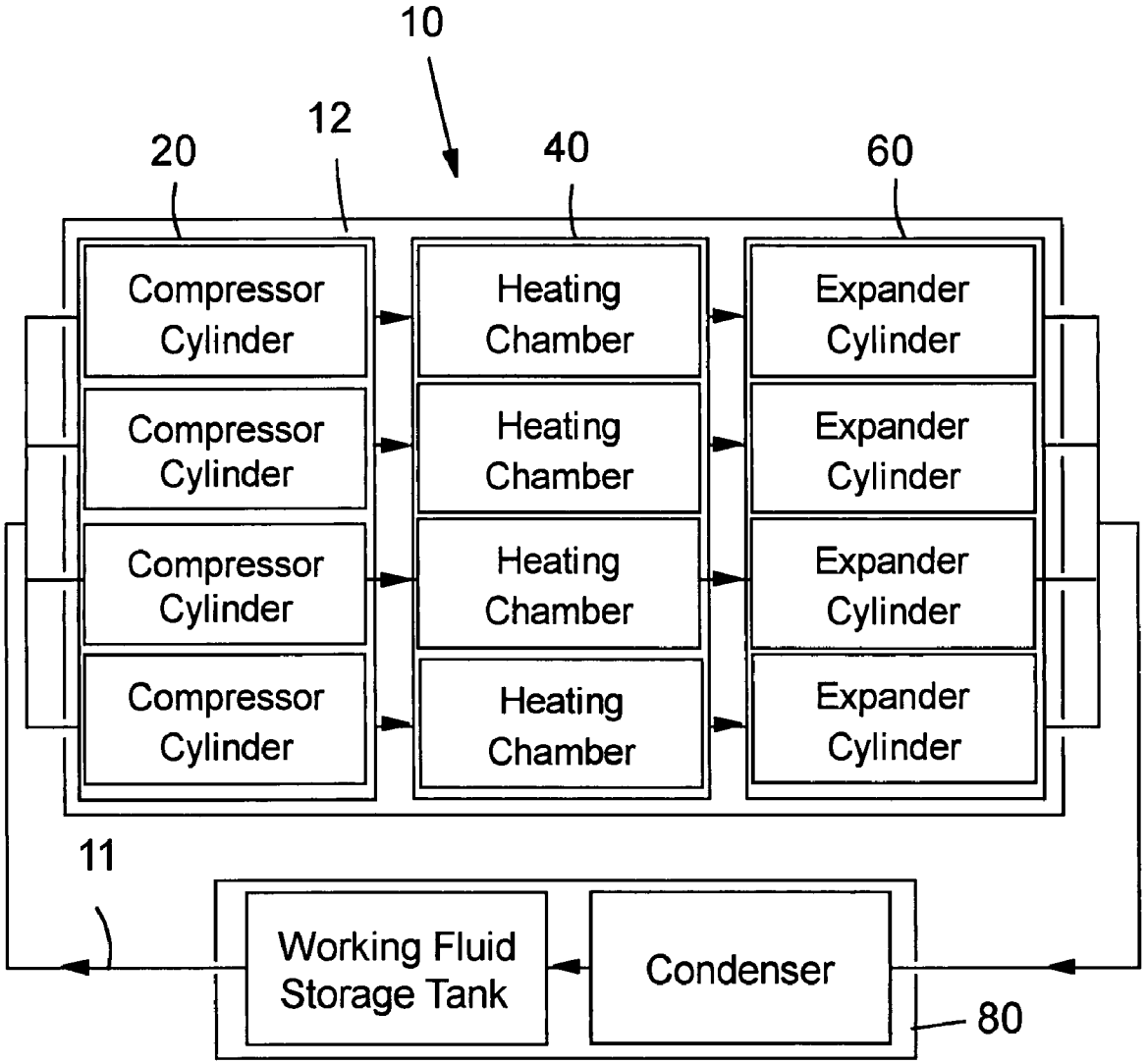
FIG. 1 shows a schematic overall system diagram of the preferred embodiment of this invention.

Reference is now made to FIG. 1 wherein a schematic overall system diagram of the preferred embodiment of this invention is shown. The externally heated engine 10 comprises a compressor assembly 20, a heater assembly 40, an expander assembly 60, a cooler assembly 80, and auxiliary systems (not shown) such as a lubrication system, an engine cooling system, and a computer system that controls the engine. The compressor, the heater and the expander assemblies are housed in the engine housing 12 separately from the cooler assembly 80, which is located in the closest vicinity practicable of the engine to minimize the travel distance by the working fluid to complete one round of circulation. The compressor assembly has a plurality of compressor cylinders; the heater assembly has the same number of heating chambers as said compressor cylinders; and the expander assembly has a plurality of expander cylinders as the compressor cylinders; and the cooler assembly has a working fluid storage tank. Each of the compressor cylinders of the compressor assembly is serially aligned with a heating chamber of the heater assembly, and an expander cylinder of the expander assembly in sequential order. The working fluid, which is generally water substance, travels from the working fluid storage tank to one of the compressor cylinders, the heating chamber, the expander chamber, the condenser, and then back to the storage tank as shown by an arrow 11.

Figure 2:
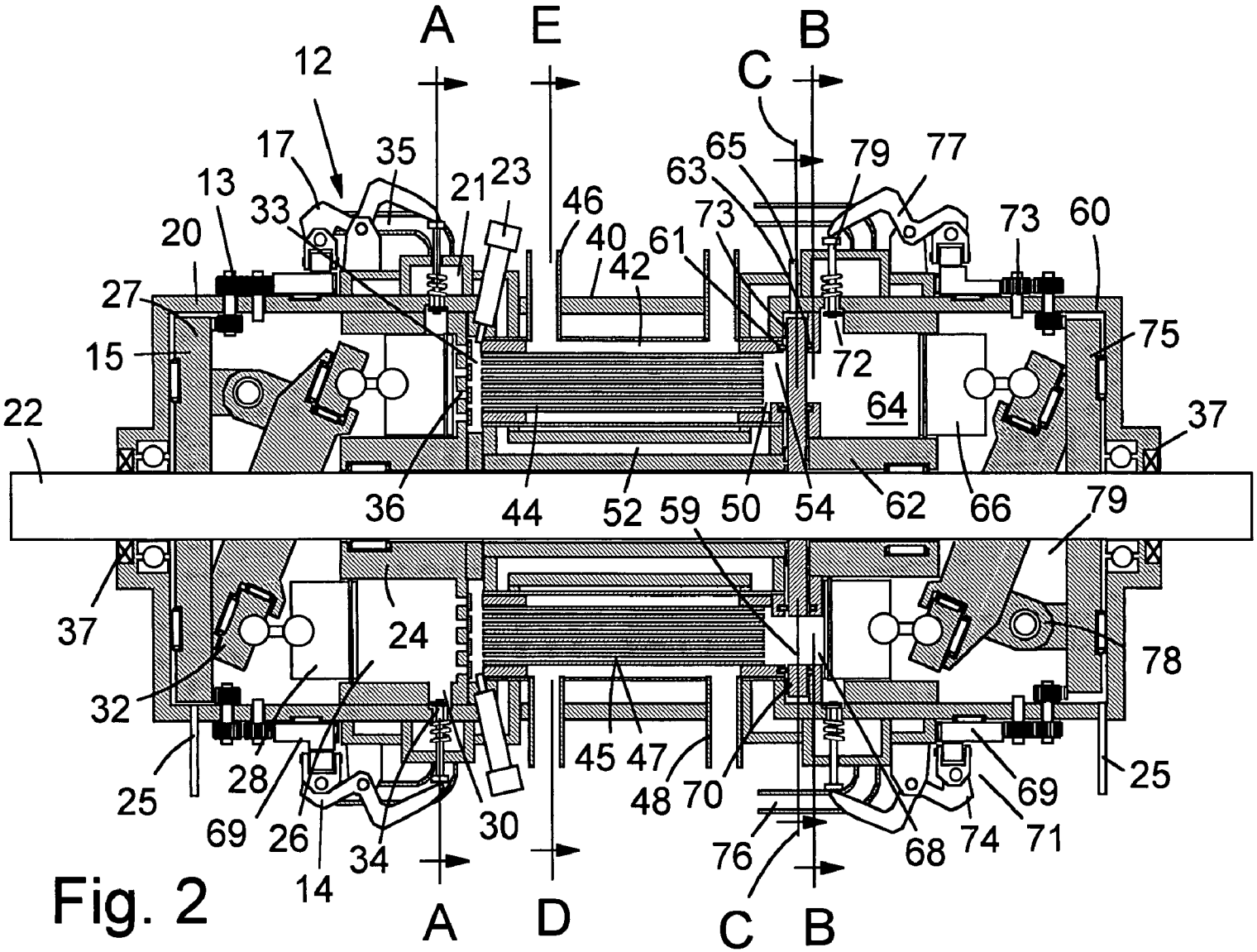
FIG. 2 shows a longitudinal cross-sectional view of a compressor assembly, a heater assembly, and an expander assembly of the preferred embodiment of the engine of this invention.

Reference is now made to FIG. 2 wherein a longitudinal cross-sectional view of a compressor assembly, a heater assembly, and an expander assembly enclosed in the engine housing 12 of the preferred embodiment of this invention is shown. The compressor assembly 20 comprises a driveshaft 22, a cylinder block 24 having a plurality of cylinders 26 formed in parallel to the driveshaft axis and arranged symmetrically to the axis of the driveshaft 22, pistons 28 that are slidably received by the cylinders 26, inlet ports 30 enclosed by inlet chambers 21, and outlet ports enclosed by outlet chambers 33, and a swash plate assembly 32. Each of the compressor cylinder functions as a working sub-chamber of the compressor assembly 20. The driveshaft 22 of the compressor assembly extends through the heater assembly 40 and the expander assembly 60, and the compressor assembly 20 and the expander assembly 60 share the driveshaft 22.

The inlet ports 30 to the compressor cylinder is equipped with poppet valves 34 that are controlled by a compressor assembly inlet port control mechanism 14, and are opened during the intake phase to allow communication between the compressor cylinder 26 and the inlet chamber 21. The inlet port control mechanism 14 comprises a ring-shaped cam 69 that rotates around the outer wall of the housing of the compressor assembly 20, a plurality of valve actuators 17, and a plurality of gear sets 13. One side of the ring-shaped cam 69 is fitted with gear teeth for meshing with one of the gears of the gear set 13. The gear set 13 rotatably connects the ring-shaped cam 69 with the support means 15, fitted with gear teeth, of the swash plate assembly 32 in such a manner that the ring-shaped cam 60 rotates one rotation while the swash plate assembly 32 rotates one rotation in the same direction. A valve actuator 17 includes a lever that is shaped like a letter W (or letter M), supported by a fulcrum in the middle and by a roller that rolls on the cam surface of the cam 69 in one end. The other end of the lever of the valve actuator presses inward the poppet valve 34 during the intake phase of the compressor assembly 20.

The inlet chamber 21 is connected to an inlet manifold 35, which is connected to the outlet pipe 93 of the cooler assembly 80. The outlet port 36 from the compressor cylinder 26 is equipped with one-way flapping valves 36 that open toward the end of the compression phase during which the pressure of the compressed vapor becomes equal to the pressure in the heating chamber 47 of the heater assembly 40. The compressed working fluid is discharged to the outlet chamber 33. The outlet chamber of the compressor assembly functions as the inlet chamber of the heating chamber 47 of the heater assembly 40. The outlet chamber 33 is equipped with a water injector 23, through which mist of water is injected immediately after the completion of the compression activity when necessary.

The compressor assembly is sealed off from the outer atmosphere by seal means 37. The rear space 27 of the compressor assembly is equipped with a water escape 25 through which the working fluid that seeped into the compressor assembly's rear space 27 is sent back to the cooler assembly. The water escape 25 is also used as the means to send the air into the compression assembly after engine operation ends.

Figure 6:
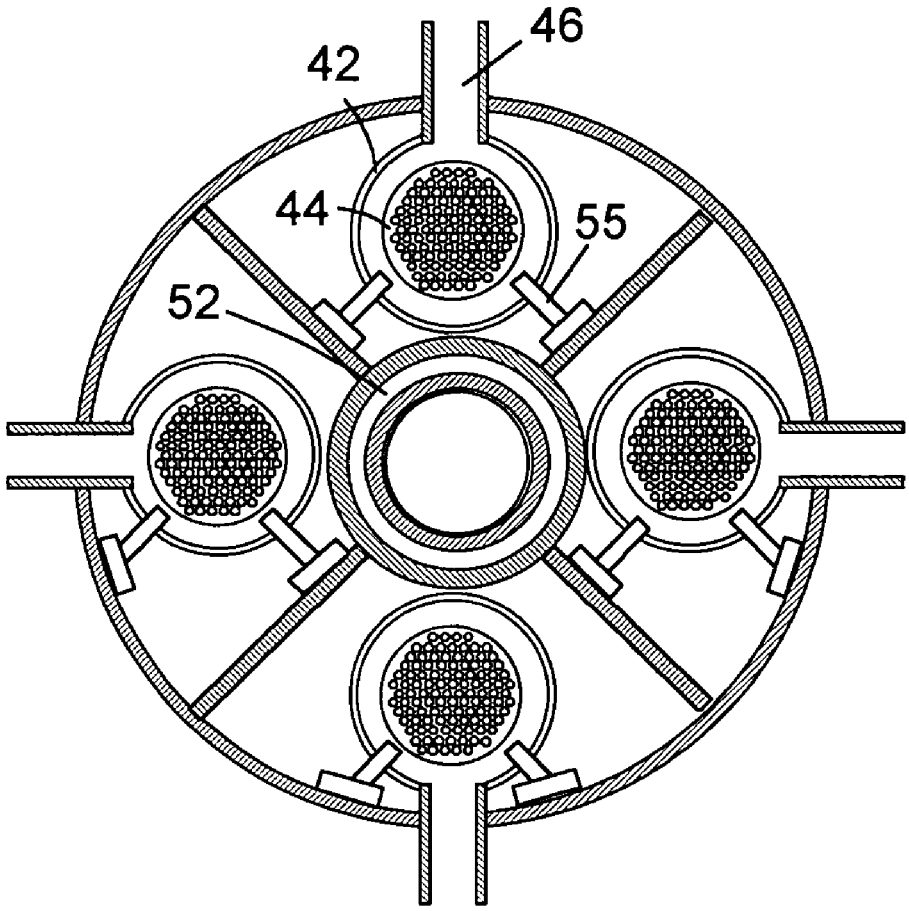
FIG. 6 shows a lateral cross-sectional view of a heater assembly of the preferred embodiment of the engine taken along D—D of FIG. 1.

The heater assembly 40 comprises a plurality of cylindrical-shaped heaters 42 arranged symmetrically to the axis of the driveshaft. Each of the heaters 42 is equipped with a heating cylinder block 44 with a plurality of cylindrical holes 45 and burners 55 (not shown in FIG. 1, but shown in FIG. 6). The cylinder block 44 of the heater 42 having an axis and it shares the axis with the compressor cylinder 26. The cylindrical holes are open ended in both ends, and extend in parallel to the axis of the cylinder block 44, and all the cylindrical holes 45 in one heating cylinder block together form one heating chamber 47, which is a working sub-chamber of the heater assembly. The working fluid is heated up in the heating chamber 47. An outlet chamber 50 is provided at the exit end of the heating chamber 47. The outlet chamber 50 has an outlet port 54 through which the heated water vapor is sent out to the expander assembly 60. The heater 42 takes in air for the burners from the air inlet port 46 and let out the exhaust air from the flue 48. The burners 55 continuously heat up the cylindrical heating block 44 of the heater 42 that takes in air from the air intake port 46, and exhausts the used air from the flue 48. The water jacket 52 shields the driveshaft 22, the outlet ports of the compressor assembly 36, and the inlet port control means the expander assembly (to be described).

The expander assembly 60 comprises the driveshaft 22, which is an extension of the driveshaft 22 of the compressor assembly, a cylinder block 62 having the same number of cylinders 64 as the compressor assembly 20, pistons 66 that are slidably received by the cylinders 64, inlet ports 68, and an inlet port control means 70 that controls opening and closing of working fluid intake, outlet ports 72 with poppet valves 79, and an expander assembly outlet port control mechanism 74, an outlet manifold 76, and a swash plate assembly 78. Each cylinder 64 of the expander assembly 60 is a working sub-chamber of the expander assembly, and shares the axis with a compressor cylinder 26, and a cylinder block 44 of the heater 42. The outlet port 54 of the heater 42 and the inlet port 68 of the expander cylinder 64 becomes communicable during the expansion phase of engine operation, wherein the opening and closing of the ports are controlled by the inlet port control means 70 with windows, which are fitted with small holes 71 (not shown in FIG. 2, but shown in FIG. 5) through which the working fluid is let out from the heating chamber to the expander cylinder. The input control means is disc-shaped, affixed to the driveshaft 22, and rotates one rotation per two engine phases; i.e., expansion phase and the exhaust phase in the expander assembly 60, and the intake phase and the compression phase in the compressor assembly. The inlet port control means 70 is housed in a narrow cylindrical space between the expander assembly and the heater assembly. The outlet port 54 of the heater 42 has a ring-shaped groove around it, and a sealing ring 61 is laid within the groove. Similarly, the inlet port 68 of the expander cylinder 64 has a ring-shaped groove around it, and is fitted with a sealing ring 63. The sealing ring 61 (and 63) works in the same manner as the piston ring of conventional engine. When the pressure increases to a certain level, the working fluid within the groove lifts up and presses the sealing ring against the control means and the outer sidewall of the groove. The narrow cylindrical-shaped space that houses the inlet port control means 70 is equipped with a safety valve 65 that releases the pressure in the heater assembly only when the pressure exceeds a predefined limit. The phasing of the swash plate assembly 32 of the compressor assembly 20 and the swash plate assembly 78 of the expander assembly are adjusted in such a manner that in every compressor cylinder and expander cylinder pair that share a cylinder axis, the start time of the compression phase in the compressor cylinder 26 coincides with the start time of the expansion phase of the expander cylinder 64.

The expander assembly outlet port control mechanism 74 comprises a ring-shaped cam 69 that rotates around the outer wall of the housing of the expander assembly 60, a plurality of valve actuators 77, and a plurality of gear sets 73. The outlet port control mechanism 77 of the expander assembly is generally identical to the inlet control mechanism 17 of the compressor assembly 20 in design.

The expander assembly is sealed off from the outer atmosphere by seal means 37. The rear space 79 of the expander assembly is equipped with a water escape 25 through which water substance that seeped into the expander assembly's rear space 79 is sent back to the cooler assembly. The water escape 25 is also used as the means to let in the after engine operation ends.

Figure 3:
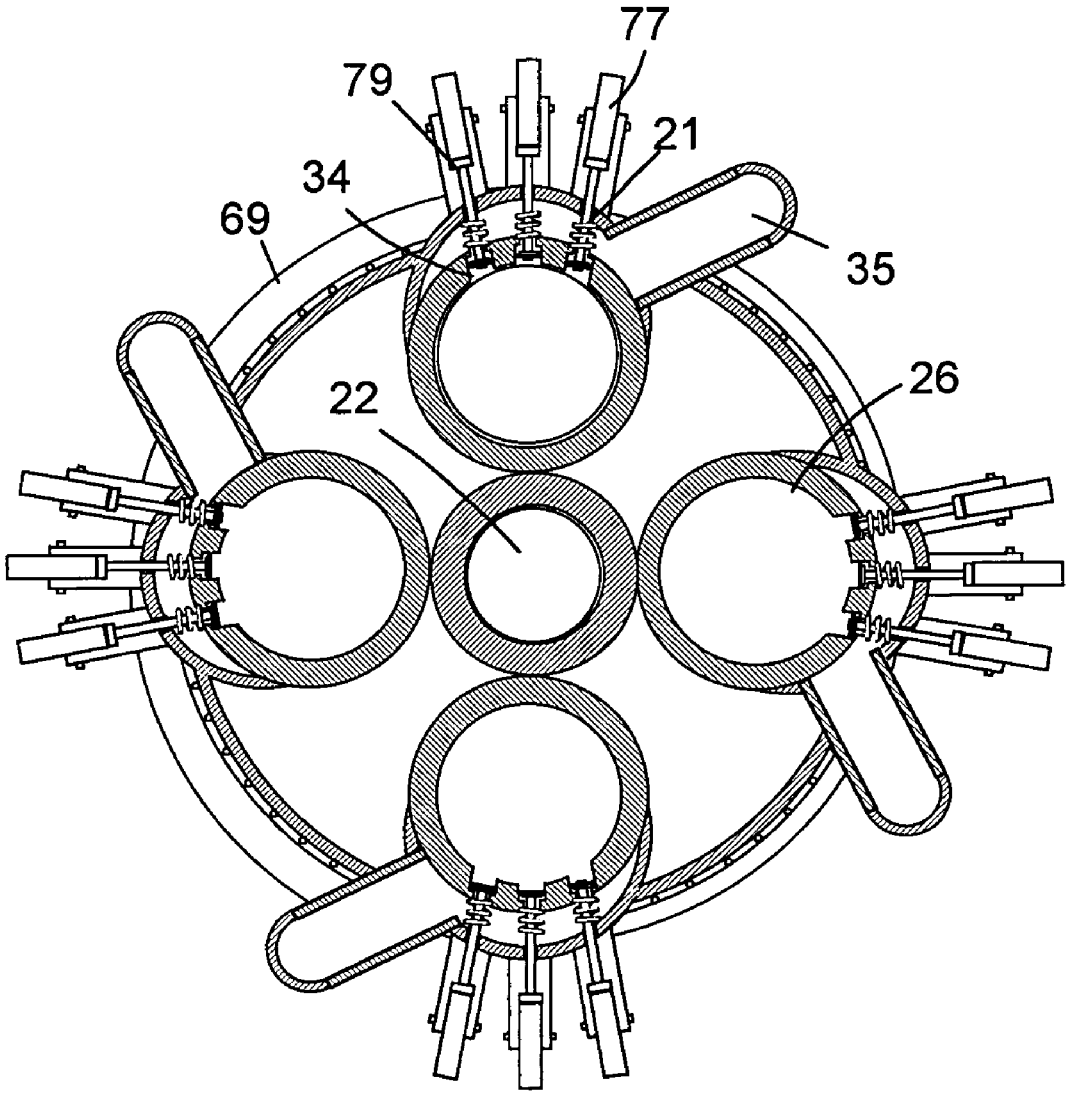
FIG. 3 shows a lateral cross-sectional view of the compressor assembly of the preferred embodiment of the engine taken along A—A of FIG. 1.

Referring to FIG. 3, wherein a lateral cross-sectional view of the compressor assembly of the preferred embodiment of the engine taken along A—A of FIG. 1 is shown, the poppet valve 34 of the inlet port 30 let the compressor cylinder 26 communicate with the inlet chamber 21 during the intake phase. The inlet chamber is connected to the inlet manifold 35, which in turn is connected to a storage tank of the cooler assembly 80. As is shown in FIG. 3, the engine of the preferred embodiment has four compressor cylinders 26, and therefore, four heater bocks 44 and four expander cylinders 64. The portion of the ring-shaped cam 69 that causes actuation (or pressing inward) of the poppet valve 34 has a width that is thicker than the rest. During the intake phase of the compressor assembly 20, the compressor cylinder 26 is communicable with the inlet chamber 21, which is connected to the inlet manifold 35.

Figure 4:
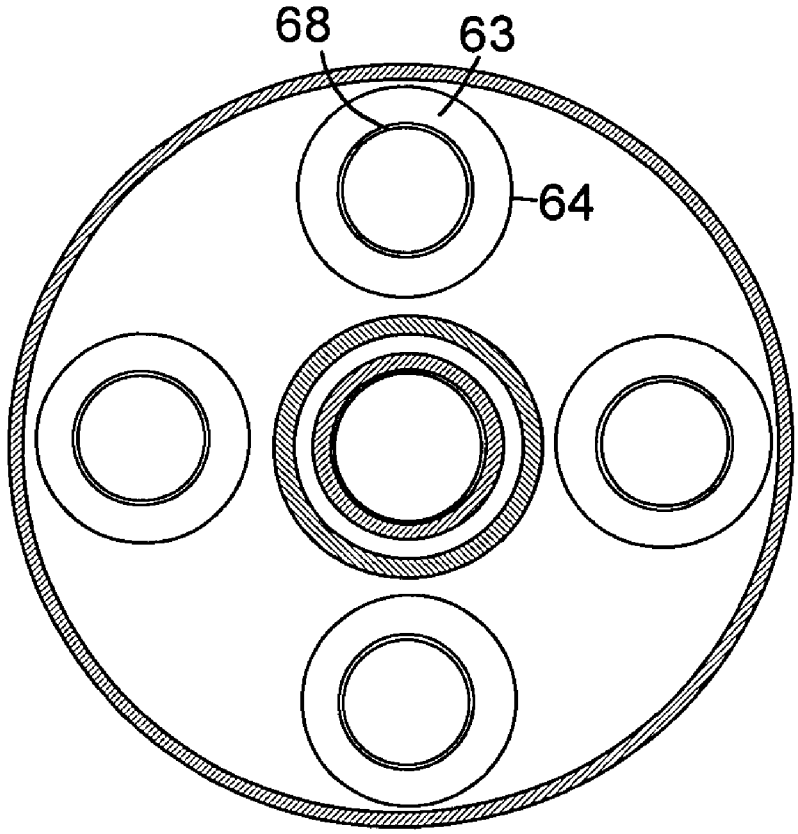
FIG. 4 shows a lateral cross-sectional view of inlet ports of the expander assembly of the preferred embodiment of the engine taken along B—B of FIG. 1.
Figure 5:
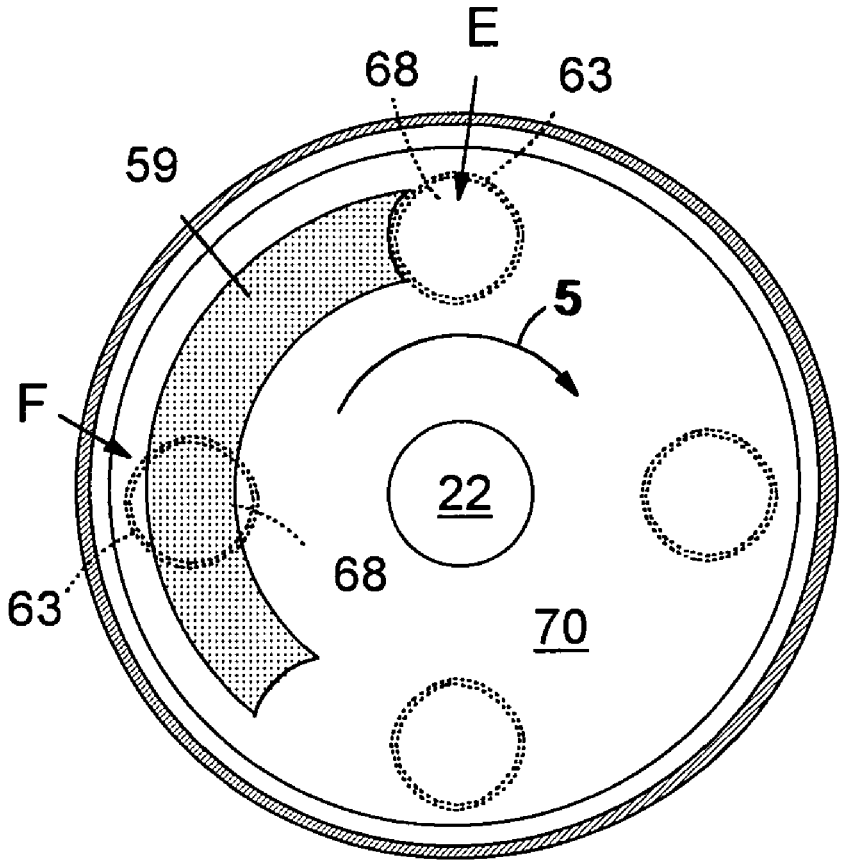
FIG. 5 shows a lateral cross-sectional view of an inlet port control means of the expander assembly of the preferred embodiment of the engine taken along C—C of FIG. 1.

Reference is now made to FIG. 4 wherein a lateral cross-sectional view of the inlet ports 68 of the expander assembly of the preferred embodiment of the engine taken along B—B of FIG. 1 is shown, and to FIG. 5 wherein a lateral cross-sectional view of an inlet port control means of the expander assembly of the preferred embodiment of the engine taken along C—C of FIG. 1 is shown. The inlet port 68 is a circular opening made on the disc-shaped wall that covers the expander cylinder 64. Similarly, the outlet port 54 (shown in FIG. 2) of the heating chamber is a circular opening on the disc-shaped wall that covers the heating chamber 47. The inlet port 68 of the expander cylinder 64 and the outlet port 54 of the heating chamber are of generally the same size, and directly facing each other except that their communication is controlled by the inlet port control mechanism 70 between them. The sealing ring 63 is laid in the ring-shaped groove that extends around the circular inlet port 68.

The inlet port control means 70 is affixed to the driveshaft 22, and has one opening 59. The outer and inner edges of the opening 59 form concentric circles, of which center is the rotational axis of the driveshaft 22, and the side edges of the opening 59 are arc-shaped. The opening 59 is provided with a plurality of small cylindrical holes. The diameter of the hole is made generally smaller than the width of the sealing ring 63 in order to prevent leaking of the working fluid to other expander cylinders. As is shown in FIG. 5, the driveshaft 22 rotates in the direction shown by an arrow 5. FIG. 5 shows that the inlet valve control means 70 is just about to open one of the inlet ports 68 indicated by letter E in FIG. 5, and another inlet port 68 indicated by letter F is currently fully open. The opening 59 is designed in such a way that flow of the working fluid into the expander cylinder is cut off before the expansion activity completes.

Figure 7:
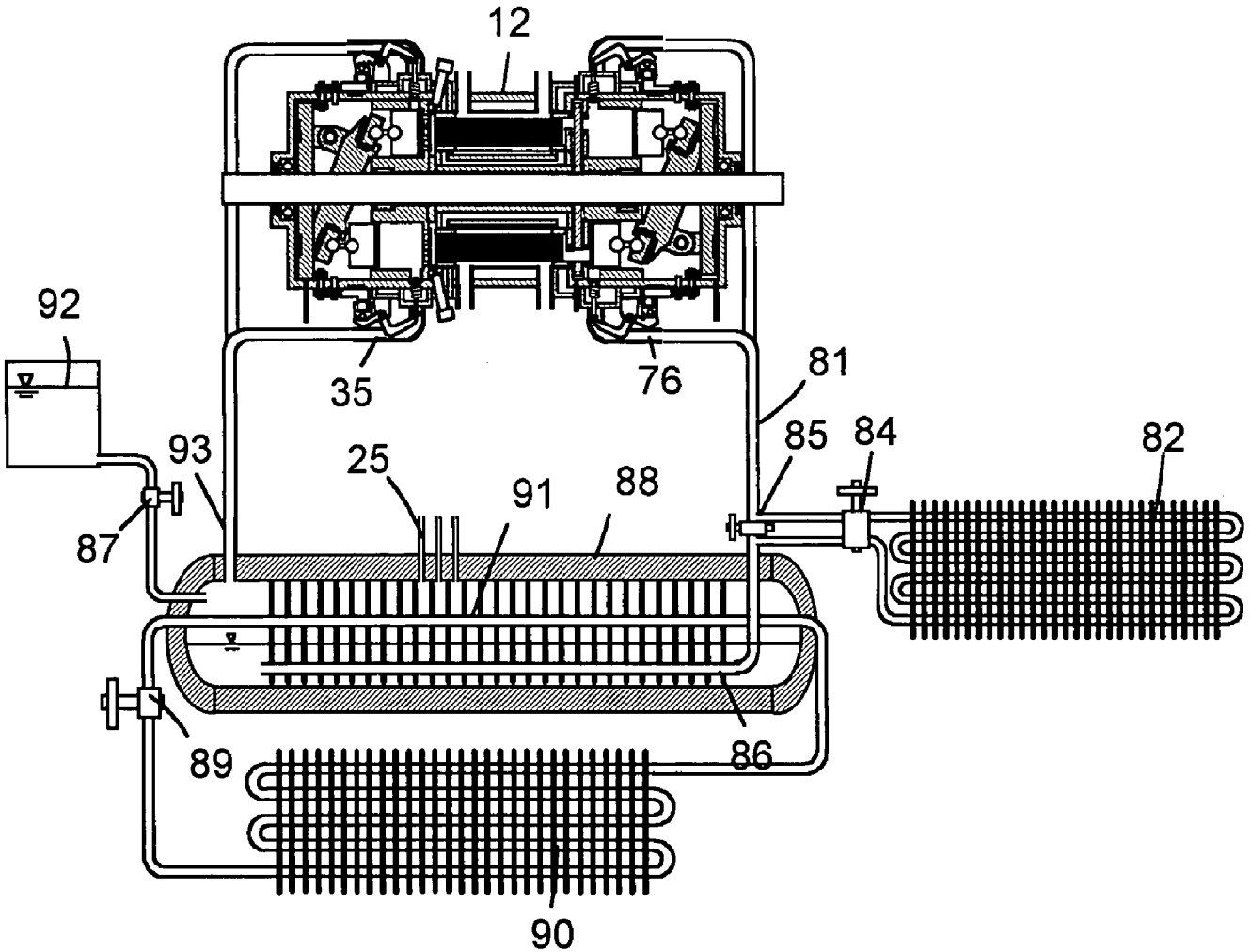
FIG. 7 shows a schematic diagram of the engine with an emphasis on the cooler assembly of the preferred embodiment.

Reference is now made to FIG. 7 wherein a schematic diagram of the engine with an emphasis on the cooler assembly 80 is shown. The cooler assembly 80 comprises first radiator 82 that cools down the exhaust vapor, a cooling pipe 86, a working fluid storage tank 88, a second radiator 90 for cooling working fluid in the storage tank, water supply tank 92, and outlet pipe 93.

The inlet pipe 81 of the cooler assembly 80 is connected to the outlet manifold 76 of the expander assembly 60 in one end, and connected to the cooling pipe 86 in the working fluid storage tank 88 in the other end. The inlet pipe 81 is equipped with valves 84 and 85 that regulate the flow of the exhaust working fluid directed to the first radiator 82. The engine control computer controls the valves 84 and 85. The cooling pipe 86 is fitted with fins extends through the working fluid storage tank 88. The working fluid storage tank stores water, water vapor and air within. A radiator pipe 91 that contains cooling liquid and connected to the second radiator 90 for cooling the working fluid is laid in parallel to the cooling pipe 86, and shares the fins with the cooling pipe 86. When the engine is not in use, the water vapor will turn into water, and thus the working fluid storage tank is filled with water and air. The outlet pipe 93 of the working fluid storage tank 88 is affixed to the outlet port located on the top wall of the tank so that the water vapor, which has a lighter molecular weight than the air is let out when the water vapor accumulates inside the working fluid storage tank. The outlet pipe 93 of the storage tank is connected to the inlet manifold 35 of the compressor assembly. At the start of engine operation, the compressor assembly takes in only air, and water mist that is injected into the heater assembly and heat from the heater 42 generates water vapor. In normal operation, the compressor assembly takes in water vapor.

Figure 8:
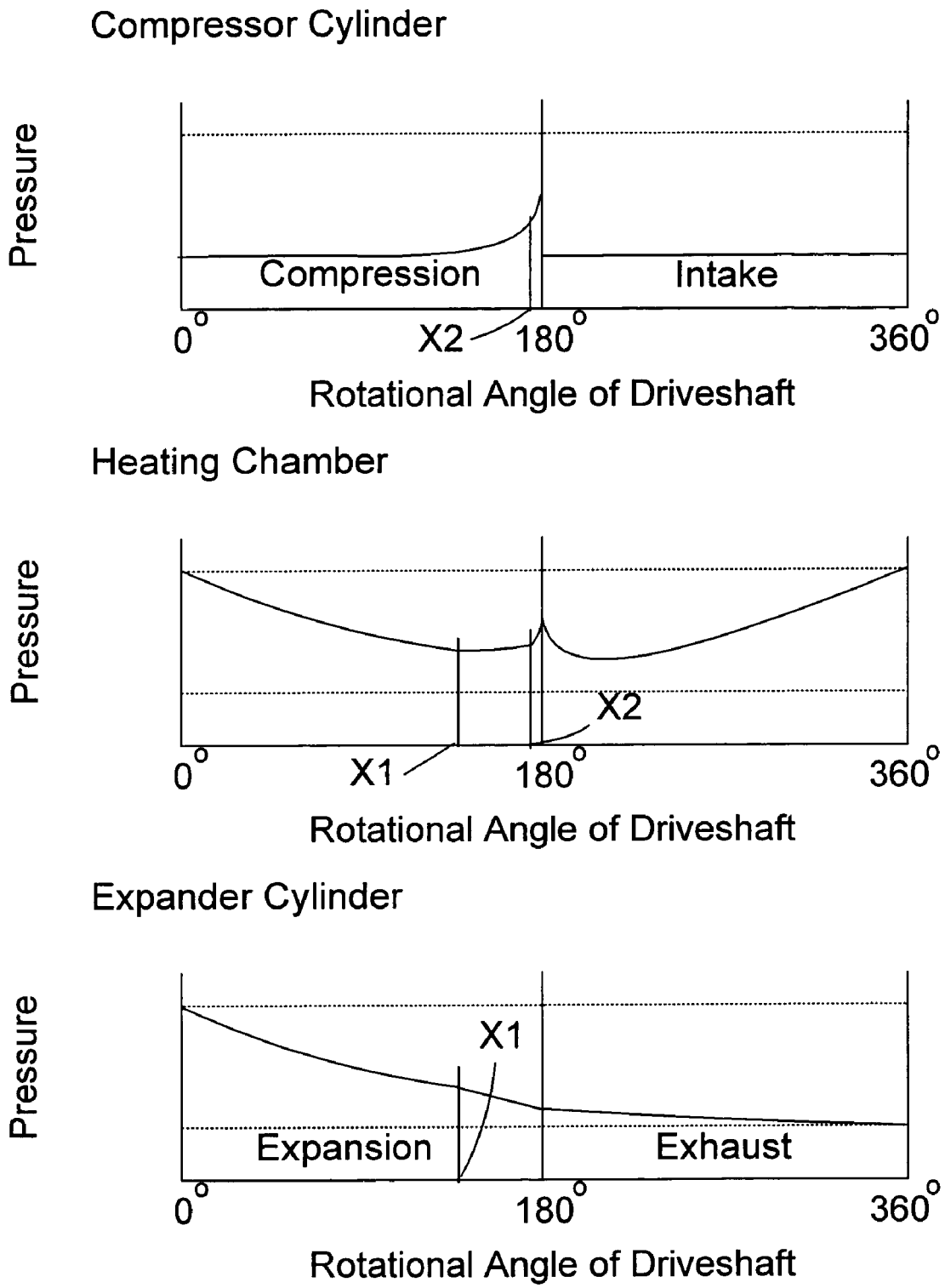
FIG. 8 shows diagrams depicting expected pressures in the compressor cylinder, the heating chamber, and the expander cylinder vs. rotational angle of the driveshaft of the preferred embodiment.

Reference is now made to FIG. 8 wherein diagrams depicting expected pressures in the compressor cylinder 26, the heating chamber 47 and the expander cylinder 64 vs. rotational angle of the driveshaft 22 of the preferred embodiment under normal operation are shown. At the start of the compression phase in the compressor cylinder 26 and the start of the expansion phase in the expander cylinder 64, the rotational angle of the driveshaft is zero.

In the compressor cylinder, the cylinder pressure is generally constant throughout the intake phase. In the compression phase, the working fluid is expected to take in some heat energy, and the pressure is expected to rise toward the end of the phase. At rotational angle X2, the compressor cylinder pressure becomes equal to the pressure in the heating chamber, and the compressed working fluid flows into the heating chamber.

In the heating chamber 47, after taking in the working fluid from the compressor cylinder, the temperature of the working fluid decreases and thus the pressure also decreases, but as the heating chamber is kept heated, the pressure keeps increasing till the inlet port 68 of the expander cylinder 64 is opened and expansion activity starts. After starting of the expansion phase, the heating chamber pressure continuously decreases as the expansion phase progresses. The pressure decrease stops at X1 when the inlet port 68 to the expander cylinder 64 closes. Shortly after closing of the inlet port 68 to the expander cylinder at X1, the inlet activity from the compressor cylinder starts at X2 when the pressure in the compressor cylinder 26 becomes equal or higher than the pressure in the heating chamber 47, and the working fluid flows into the heating chamber. If the pressure rise in the compressor cylinder is faster than shown in FIG. 8, or the pressure decrease in the heating chamber is faster than shown in FIG. 8, X2 can occur before X1.

The expander cylinder pressure during the expansion phase before the closure of the inlet port 68 is similar to that of the heating chamber. After closing the inlet port 68, the expander cylinder pressure continuously decreases till the end of the exhaust phase.

Figure 9:
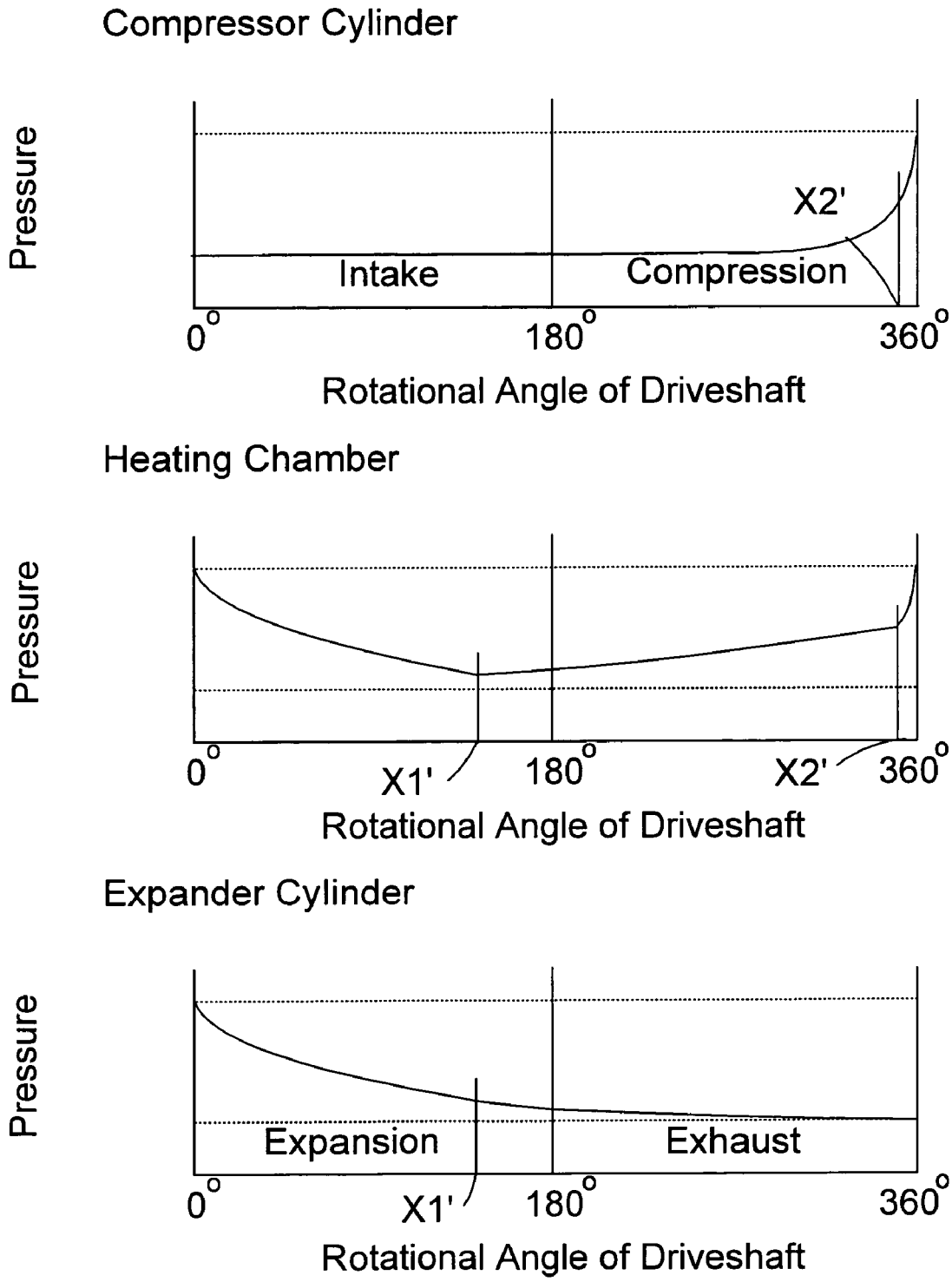
FIG. 9 shows diagrams depicting expected pressures in the compressor cylinder, the heating chamber, and the expander cylinder vs. rotational angle of the driveshaft of an alternative embodiment.

Reference is now made to FIG. 9 wherein diagrams depicting expected pressures in the compressor cylinder, the heating chamber, and the expander cylinder vs. rotational angle of the driveshaft of an alternative embodiment under normal operation are shown. In the alternative embodiment, the phasing of the swash plates of the compressor and expander assemblies are adjusted in such a manner that the start of the intake phase of the compressor cylinder will coincide the start of the expansion phase of the paired expander cylinder.

In Variation of the pressure in the compressor cylinder 26 along rotational angle of the driveshaft in this alternative embodiment is similar to that of the preferred embodiment except that the start time of the compression activity in this alternative embodiment is shifted by a half rotation. In the heating chamber, the pressure peaks after the intake of the working fluid from the compression chamber, and the expansion phase starts immediately after taking in the working fluid into the heating chamber. At the end of the compression activity, the residual of the working fluid from the last cycle in the heating chamber 47 should have substantially higher temperature than in the preferred embodiment. At the start of the expansion phase, the heated working fluid is taken out from the outlet end of the heating chamber while the heating of the working fluid newly taken in from the compression chamber is just about to mix with the residual working fluid in the heating chamber. By the end of the expansion phase, the not-fully-heated working fluid should mix with the older full-heated working fluid, and let out of the heating chamber. The pressure variation in the expansion cylinder is similar to that in the preferred embodiment even though we do not know exactly how these two embodiments will perform.

Figure 10:
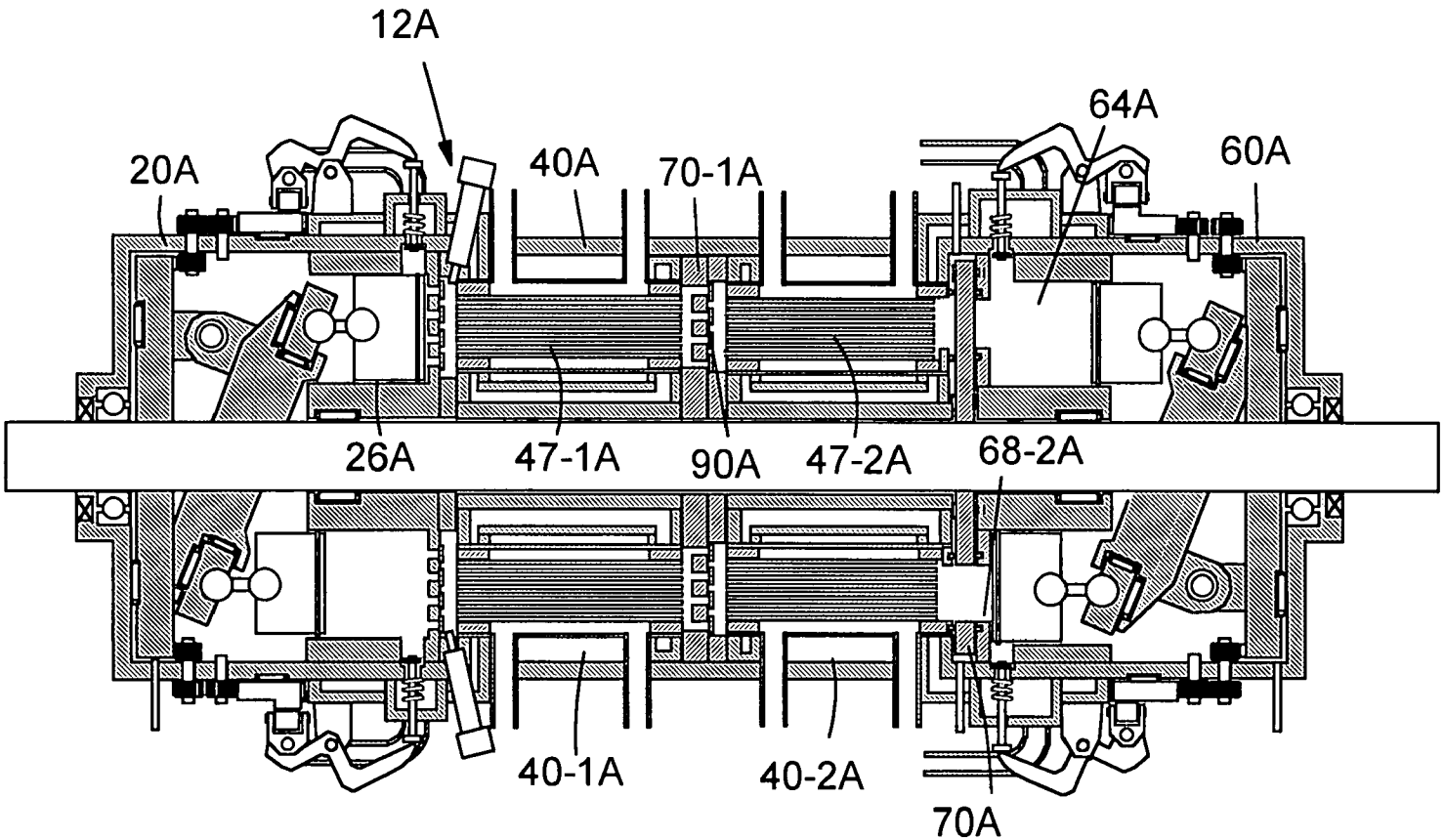
FIG. 10 shows a longitudinal cross-sectional view of a compressor assembly, a heater assembly, and an expander assembly of the alternative embodiment.

Reference is now made to FIG. 10 wherein a longitudinal cross-sectional view of a compressor assembly 20A, a heater assembly 40A, and an expander assembly 60A of an alternative embodiment enclosed in an engine housing 12A is shown. This alternative design includes serially aligned two heater sub-assemblies 40–1A and 40–2B, wherein the boundary of neighboring heater sub-assemblies is separated by a divider port assembly 90A equipped with one-directional flapping valves. Each of the heater sub-assemblies has the same number of heating chambers, and each heating chamber 47–1A in the heater sub-assembly 40–1A is serially aligned with a heating chamber 47–2A of the heater sub-assembly 40–2A. The heating chambers 47–1A of the heater sub-assembly 40–1A are called first heating chambers, and the heating chambers 47–2A of the heater sub-assembly 40–2A are called second heating chambers. Except for these modifications, this alternative embodiment of the engine design is generally identical to that of the preferred embodiment. In operation, a heating chamber of the heater sub-assembly 40–1A functions as a booster, and the working fluid stays within as long as the pressure inside the heating chamber of the heater sub-assembly 40–2A is less than the pressure in the compressor cylinder. It must be apparent that the heater assembly may include more than two serially aligned sub-assemblies.

Figure 11:
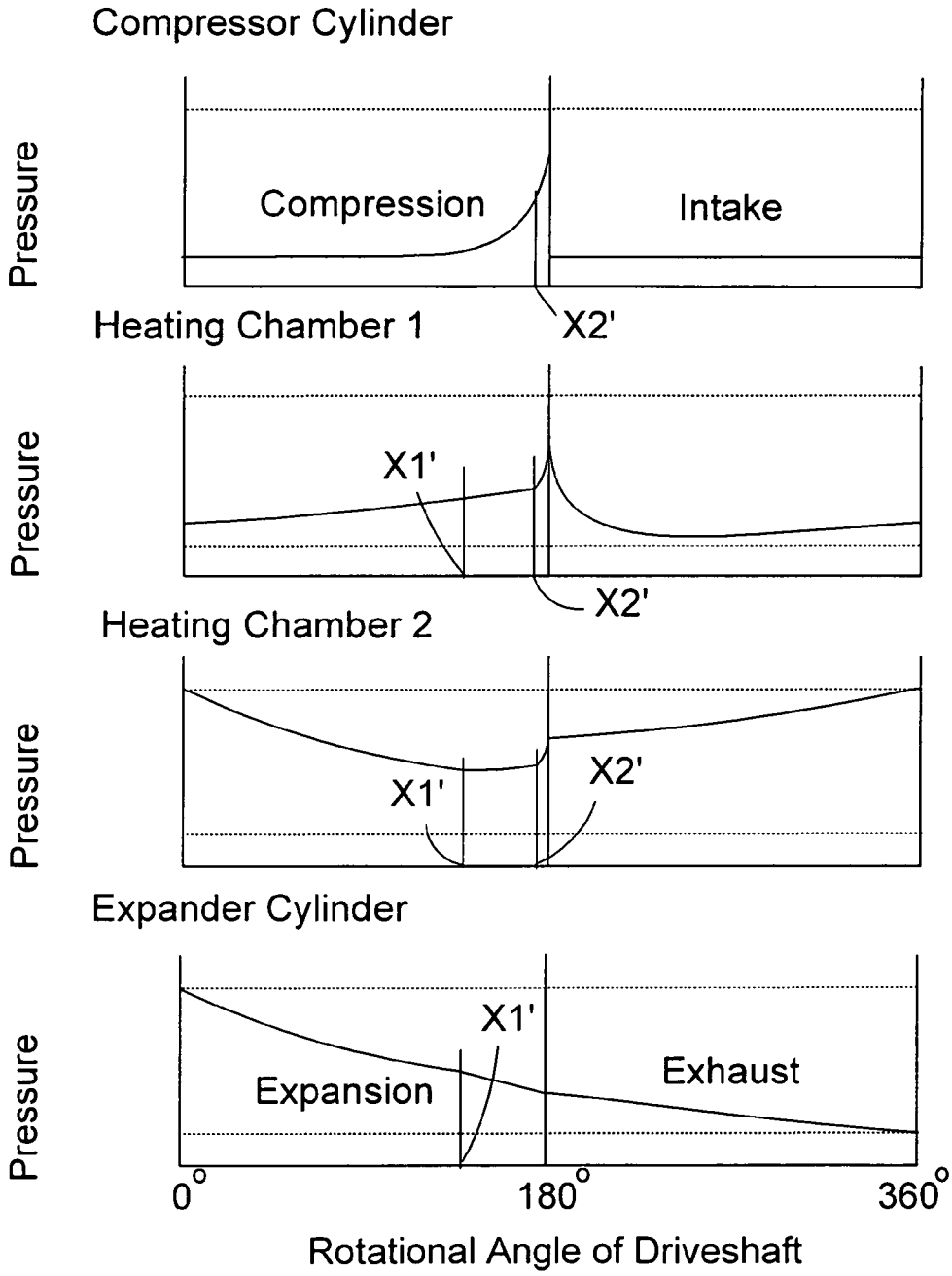
FIG. 11 shows diagrams depicting expected pressures in the compressor cylinder, the heating chamber, and the expander cylinder vs. rotational angle of the driveshaft of the alternative embodiment shown in FIG. 10.
Figure 12:
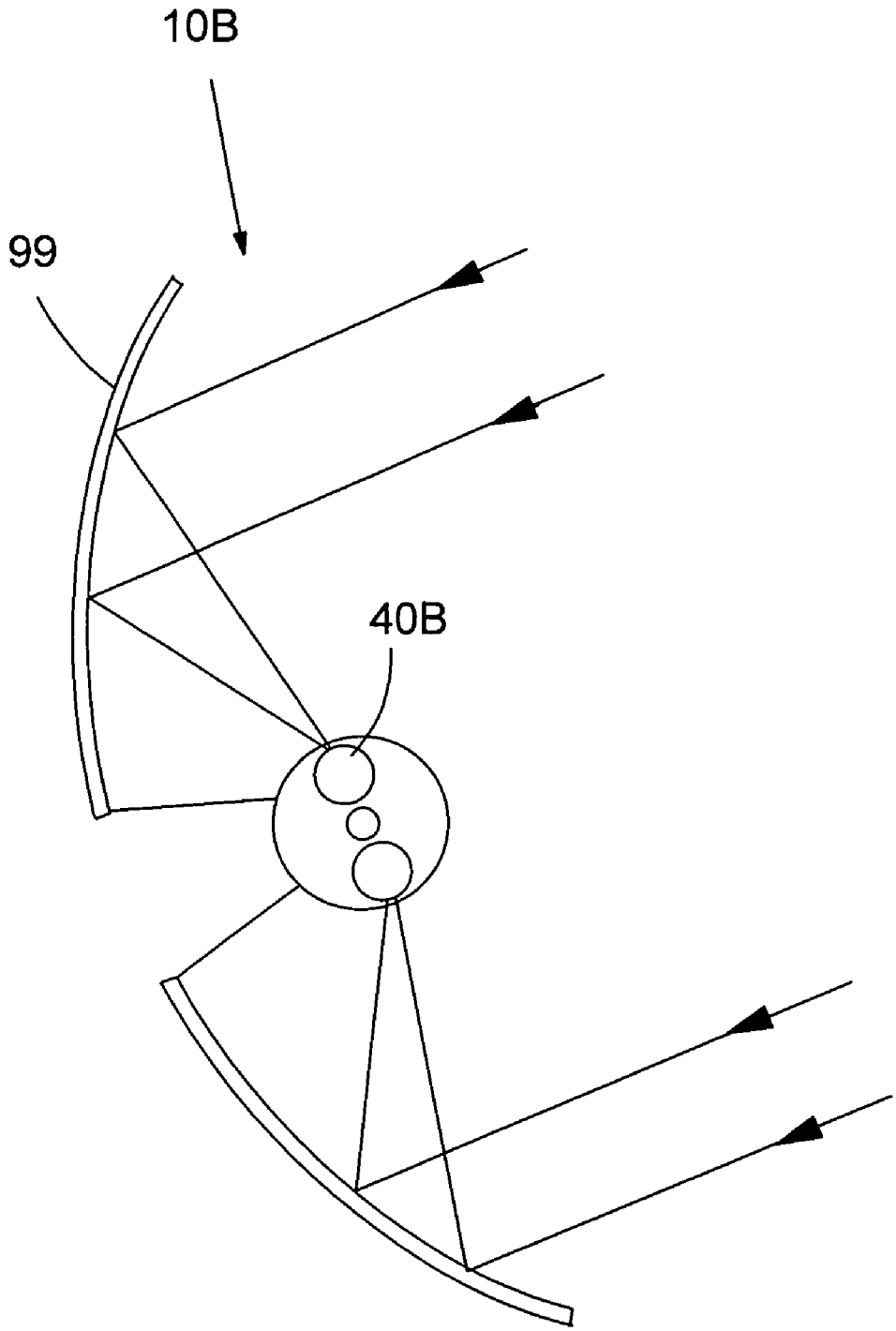
FIG. 12 shows a cross-sectional view of the heater assembly and a reflector of an alternative embodiment that uses sunlight for the source of energy.

Reference is now made to FIG. 11 wherein diagrams depicting the pressures in the compressor cylinder, the first heating chamber, the second heating chamber, and the expander cylinder vs. rotational angle of the driveshaft of the preferred embodiment under normal operation are shown. As is shown in FIG. 12, at the start of the compression phase in the compressor cylinder and the start of the expansion phase in the expander cylinder, the rotational angle of the driveshaft is zero.

Variation of the pressure in the compressor cylinder 26 along rotational angle of the driveshaft in this alternative embodiment is similar to that of the preferred embodiment. At rotational angle X2', when the compressor cylinder pressure becomes equal to the pressure in the first heating chamber, the compressed working fluid flows into the first heating chamber of the first heating sub-assembly 40–1A.

In the first heating chamber, after taking in the working fluid from the compressor cylinder, the chamber temperature and pressure initially decreases. Afterwards, the pressure in the first heating chamber gradually increases till the divider ports between the first and second heating chambers are opened at X2' in the next cycle. In the second heating chamber, at or before the opening of the outlet port of the compressor cylinder, when the pressure in the first heating chamber and the second heating chamber becomes equal, the heated working fluid in the first heating chamber is let out to the second heating chamber. The pressure in the second heating chamber will continuously increase till the opening of the inlet port 68 of the expander cylinder 64 at the start of the expansion phase. In the expansion phase of the expander cylinder 64, the pressure in the second heating chamber decreases till X1, at which point, the inlet port to the expander cylinder closes. After closing of the inlet port to the expander cylinder, the pressure starts to increase.

The expander cylinder pressure during the expansion phase before the closure of the inlet port is similar to that of the second heating chamber. After closing the inlet port, the expander cylinder pressure continuously decreases till the end of the exhaust phase.

Reference is now made to FIG. 12, wherein a lateral cross-sectional view of the heater assembly and a reflector of an alternative embodiment that uses sunlight for the source of energy are shown. In this alternative embodiment, the engine 10B includes a heater assembly 40B equipped with a reflection mirror and serially aligned multiple sub-chambers. At least a part of the heater block of the heater assembly 40B is exposed to the outer atmosphere, and placed at the focal points of a set of reflecting mirrors. The heater assembly 40B may include fossil fuel burners placed in an enclosed space directly below the heater block in addition to a reflector mirror 99.

In another alternative embodiment, the inlet port valves of the compressor assembly are one-way flapping valves. In another alternative embodiment, the first radiator, the working fluid storage tank, and the second radiator are submerged in a pool of water in a water tank. In another alternative embodiment, the compressor assembly is a pump to pump in the water into the heater assembly, and is substantially smaller than that of the expander assembly. This alternative embodiment is generally identical to the preferred embodiment except that the displacement capacity of the compressor assembly is substantially smaller than that of the preferred embodiment, the phasing arrangement of swash plate assemblies of the compressor assembly and the expander assembly is 180 degrees off of the preferred embodiment, and the intake ports will use one-way valves instead of poppet valves. In another embodiment, the engine is equipped with a water injector assembly with a plurality of water injectors. This alternative includes no compressor assembly. The water injector directly injects the water into the inlet chamber of the heating chamber. In another embodiment, a fuel injector and a spark plug are provided in the expander cylinder. In another alternative embodiment, a water injector is provided in the cooling pipe of the expander cylinder. in another alternative embodiment, the heating chamber 40B includes a plurality of serially connected heating sub-chambers.

The invention having been described in detail in accordance with the requirements of the U.S. Patent Statutes, various other changes and modifications will suggest themselves to those skilled in this art. For example, the cooler assembly without the first radiator or the second radiator is possible. An additive may be added to the water to prevent the water from freezing in cold climate in winter. A drive mechanism other than the swash plate type may be used. It is intended that the above and other such changes and modifications shall fall within the spirit and scope of the invention defined in the appended claims.

I claim:

1. An external combustion engine comprising a compressor assembly a heater assembly, an expander assembly, a cooler assembly, and auxiliary systems wherein said compressor assembly having a plurality of compressor cylinders, said cooler assembly having a condenser and a working fluid storage tank.

said heater assembly having a plurality of heater sub-assemblies, said heater sub-assemblies serially aligned, boundary of neighboring heater sub-assemblies being separated by a divider port assembly equipped with one-directional valves, said heater sub-assembly having plurality of heating chambers, said expander assembly having a plurality of expander cylinders, said compressor assembly having a driveshaft, said expander assembly having a driveshaft, and inlet port control means, said driveshaft of said expander assembly is extension of said driveshaft of said compressor assembly, said compressor assembly, said heater assembly, and said expander assembly are housed in same engine housing, said heater assembly is sandwiched by said compressor assembly and said expander assembly, said external combustion engine using working fluid, and said working fluid travels from said working fluid storage tank to said compressor cylinder, then to said heating chambers of said serially arranged heater sub-assemblies, then to said exnander chamber, then to said condenser, and then hack to said working fluid storage tank.

2. The external combustion engine as defined in claim 1, wherein said compressor cylinder of said compressor assembly taking in generally water vapor for working fluid.

3. The external combustion engine as defined in claim 1, wherein said compressor cylinder of said compressor assembly being substantially smaller than said expander cylinder of said expander assembly, and said compressor assembly taking in generally water.

4. The external combustion engine as defined in claim 1, wherein said compressor cylinder having an intake phase and a compressor phase, said expander cylinder having an exhaust phase and an expansion phase.

said intake phase of said compressor cylinder and said exhaust phase of said serially aligned expander cylinder start generally at the same time.

5. The external combustion engine as defined in claim 1, wherein said compressor cylinder having an intake phase and a compressor phase, said expander cylinder having an exhaust phase and an expansion phase, said compression phase of said compressor cylinder and said exhaust phase of said serially aligned expander cylinder start generally at the same time.

6. The external combustion engine as defined in claim 1, wherein said heater assembly includes a reflector mirror.

7. The external combustion engine as defined in claim 1, wherein said heater assembly includes a plurality of fossil fuel burners.

8. The external combustion engine as defined in claim 1, wherein said heater assembly includes a reflector mirror and a plurality of fossil fuel burners.

9. An external combustion engine comprising a water injector assembly, a heater assembly, an expander assembly, a cooler assembly, and auxiliary systems wherein said water injector assembly having a plurality of water injectors, said cooler assembly having a condenser and a working fluid storage tank, said heater assembly having a plurality of heater sub-assemblies, said heater sub-assemblies serially aligned, boundary of neighboring heater sub-assemblies being separated by a divider port assembly equipped with one-directional valves, said heater sub-assembly having plurality of heating chambers.

said expander assembly having a plurality of expander cylinders, and said working fluid travels from said working fluid storage tank to said injector, Then to said heating chambers of said serially arranged heater sub-assemblies, then to said expander chamber, then to said condenser, and then back to said working fluid storage tank.

10. The external combustion engine as defined in claim 9, wherein said heater assembly includes a reflector mirror.

11. The external combustion engine as defined in claim 9, wherein said heater assembly includes a plurality of fossil fuel burners.

12. The external combustion engine as defined in claim 9, wherein said heater assembly includes a reflector mirror and a plurality of fossil fuel burners.

* * * * *